US009609931B2

(12) United States Patent
Rosenblatt et al.

(10) Patent No.: US 9,609,931 B2
(45) Date of Patent: Apr. 4, 2017

(54) CARRYING CASE FOR A WIG

(71) Applicant: Eli Rosenblatt, Lakewood, NJ (US)

(72) Inventors: Eli Rosenblatt, Lakewood, NJ (US); David Cowan, Cornwall Bridge, CT (US); Benjamin Zelnick, Brooklyn, NY (US)

( * ) Notice: Subject to any disclaimer, the term of this patent is extended or adjusted under 35 U.S.C. 154(b) by 24 days.

(21) Appl. No.: 14/579,984

(22) Filed: Dec. 22, 2014

(65) Prior Publication Data

US 2015/0173531 A1 Jun. 25, 2015

Related U.S. Application Data

(60) Provisional application No. 61/918,983, filed on Dec. 20, 2013, provisional application No. 61/992,371, filed on May 13, 2014.

(51) Int. Cl.

| | |
|---|---|
| ***A45C 11/02*** | (2006.01) |
| ***A45C 13/02*** | (2006.01) |
| ***A45C 5/08*** | (2006.01) |
| ***A45C 13/00*** | (2006.01) |
| ***A45C 11/00*** | (2006.01) |

(52) U.S. Cl.

CPC ..... *A45C 13/02* (2013.01); *A45C 5/08* (2013.01); *A45C 11/00* (2013.01); *A45C 13/005* (2013.01)

(58) Field of Classification Search

CPC ... A45C 11/02; A45C 3/12; A47F 7/06; A47F 7/065

USPC ..... 206/8; 211/100; 223/66

See application file for complete search history.

(56) References Cited

U.S. PATENT DOCUMENTS

| | | | | | |
|---|---|---|---|---|---|
| 561,473 | A | * | 6/1896 | Bailey | A47F 7/06 211/181.1 |
| 607,310 | A | * | 7/1898 | Wellock | A47F 7/06 211/197 |
| 2,719,688 | A | * | 10/1955 | Seifert | A47F 7/06 248/188.5 |
| 3,008,568 | A | * | 11/1961 | Van Doren | A45C 11/02 206/8 |
| 3,289,822 | A | | 12/1966 | Schumer | |
| 3,289,823 | A | | 12/1966 | Gottlieb | |
| 3,310,162 | A | | 3/1967 | Bayer | |
| 3,310,267 | A | * | 3/1967 | Koehler | A47F 7/065 206/8 |
| 3,522,899 | A | * | 8/1970 | Garriques | 215/255 |
| 3,568,899 | A | * | 3/1971 | Rosenberg | A45D 44/14 206/8 |
| 3,587,836 | A | * | 6/1971 | Brown | A45C 11/00 206/8 |
| 3,603,322 | A | | 9/1971 | Wilson | |
| 3,628,655 | A | | 12/1971 | Bohannon | |

(Continued)

FOREIGN PATENT DOCUMENTS

DE 4003821 A1 * 8/1991 ..... A45D 44/14

*Primary Examiner* — Sue A Weaver

(74) *Attorney, Agent, or Firm* — Amster, Rothstein & Ebenstein LLP

(57) ABSTRACT

A carrying case for a wig. The case is made of two panels that are joined together by hinges. One panel has a floor surface that extends in a lateral direction past a roof section. The floor surface has a post for receiving a wig head. Contact members are deployable to protrude from the post and burrow into or otherwise press against the inside walls of a channel provided in a wig head.

10 Claims, 7 Drawing Sheets

(56) References Cited

U.S. PATENT DOCUMENTS

| | | | | | |
|---|---|---|---|---|---|
| 3,653,563 | A * | 4/1972 | Russ | A45D 44/14 | 206/8 |
| 3,658,174 | A * | 4/1972 | Friedman | A45C 11/00 | 206/8 |
| 3,715,028 | A | 2/1973 | Schumer | | |
| 3,741,448 | A * | 6/1973 | Friedman | A45D 44/14 | 223/66 |
| 3,770,114 | A | 11/1973 | Jackson | | |
| 4,470,527 | A * | 9/1984 | Middleton | F16B 7/10 | 223/66 |
| 8,167,128 | B2 * | 5/2012 | McGinnis | A45C 11/20 | 206/551 |

* cited by examiner

CARRYING CASE FOR A WIG

RELATED APPLICATIONS

This application claims the benefit of U.S. Prov. Appl. Ser. No. 61/992,371 filed May 13, 2014 and U.S. Prov. Appl. Ser. No. 61/918,983 filed Dec. 20, 2013 the contents of which are incorporated by reference herein.

FIELD OF THE INVENTION

The invention relates to the field of luggage devices, more specifically to a case for carrying and securing a wig on a wig head.

BACKGROUND OF THE INVENTION

Many people wear wigs for various reasons, ranging from health reasons to religious considerations. Wigs are delicate items and they must be handled carefully in transport. The carrying cases for wigs currently available on the market are unwieldy and they not user friendly. For example, currently available wig carriers are generally square or rectangular cases that have an outwardly opening door. The door occupies space when the carrier is open and a wig head must be slid into the box in a lateral direction. In addition, current wig carriers do not allow for the wig head to be secured within the carrier. These and other factors make current wig cases difficult to use and there is a need in the art for an improved wig carrier case.

SUMMARY OF THE INVENTION

The wig carrying case described herein is an elongated carrying case made of two segments that are joined by a hinge that runs parallel to the longitudinal axis of the carrier. The two segments, when brought together, form a housing to enclose a wig. A first segment has a floor surface that extends in a lateral direction past its roof surface. An upwardly projecting cylindrical bar is mounted to the floor surface of the first segment and which serves to anchor a wig head. Because the floor surface upon which the cylindrical bar is positioned extends past the roof section, a user may place a wig head directly in a downward motion onto the bar—without having to laterally slide the wig head into the case. Moreover, because the carrier opens along its longitudinal axis—a user has closer access to the inside of the carrier. In addition, the inventive wig carrier occupies less space than wig carrier having a front opening door, and as such, it may be opened in more confined spaces, such as in a crowded dressing room or in an automobile.

The post which inserts into the inside pocket or channel of a Styrofoam wig head has contacting members that extend laterally therefrom. The contact members contact the inside walls of the channel thereby securing the wig head in place.

DETAILED DESCRIPTION OF THE INVENTION

Embodiments of the present invention will now be described with reference to the above-identified Drawings. However, the Drawings and the description herein of the invention are not intended to limit the scope of the invention. It will be understood that various modifications of the present description of the invention are possible without departing from the spirit of the invention. Also, features described herein may be omitted, additional features may be included, and/or features described herein may be combined in a manner different from the specific combinations recited herein, all without departing from the spirit of the invention.

Figure 1:
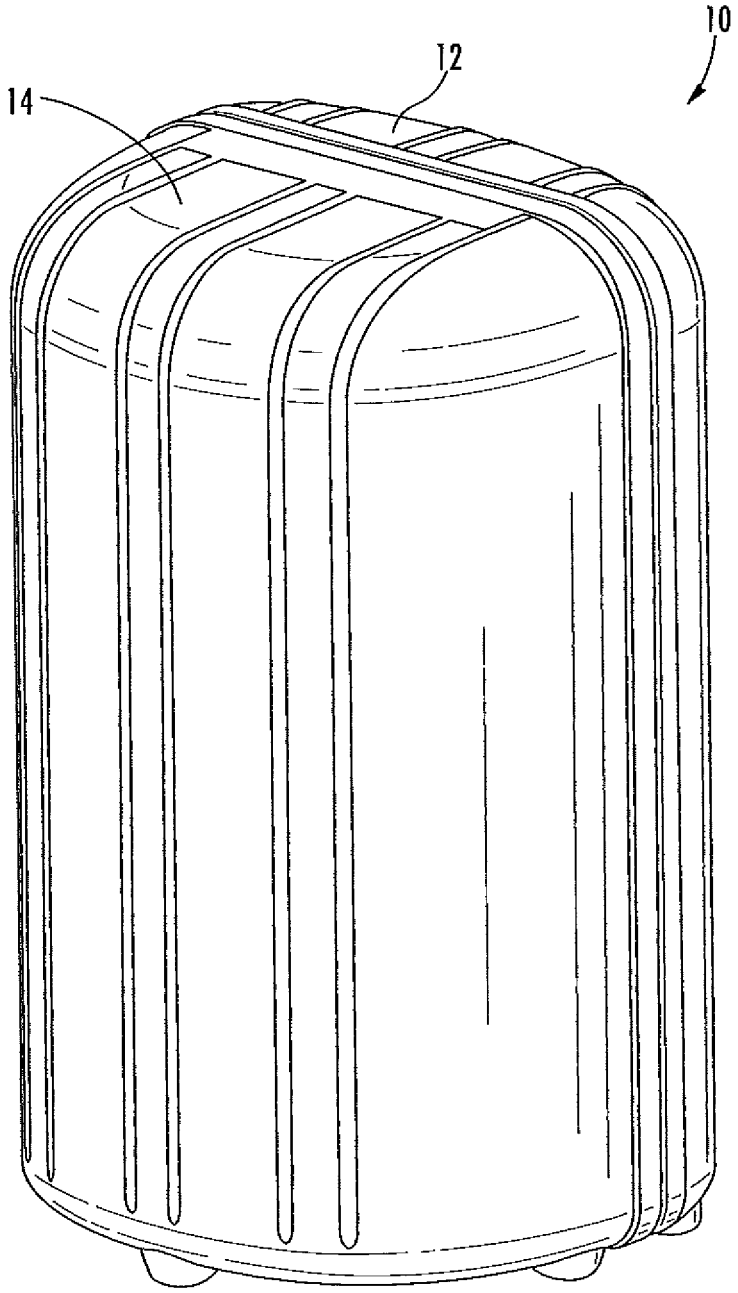
FIG. 1 is a side perspective view of a closed carrying case according to an embodiment of the invention.

FIG. 1 shows a wig carrier 10 that is fastened closed according to an embodiment of the invention. As shown, carrier 10 is a generally elongated housing that is made of two corresponding panels 12, 14. Panels may be formed of hard plastic or similar lightweight material. First panel 12 and second panel 14 are joined by way of a hinge or similar pivoting member. In the embodiment shown, when the carrier 10 is closed, the longitudinal seam between panel 12 and panel 14 is off-centered. That is, the width of panel 14 (i.e. the distance between the outer wall 15 and inner edge 19 shown in FIG. 2) is greater than the width of panel 12 (i.e. the distance between the outer wall 15*a* and 19*a* shown in FIG. 2).

Figure 2:
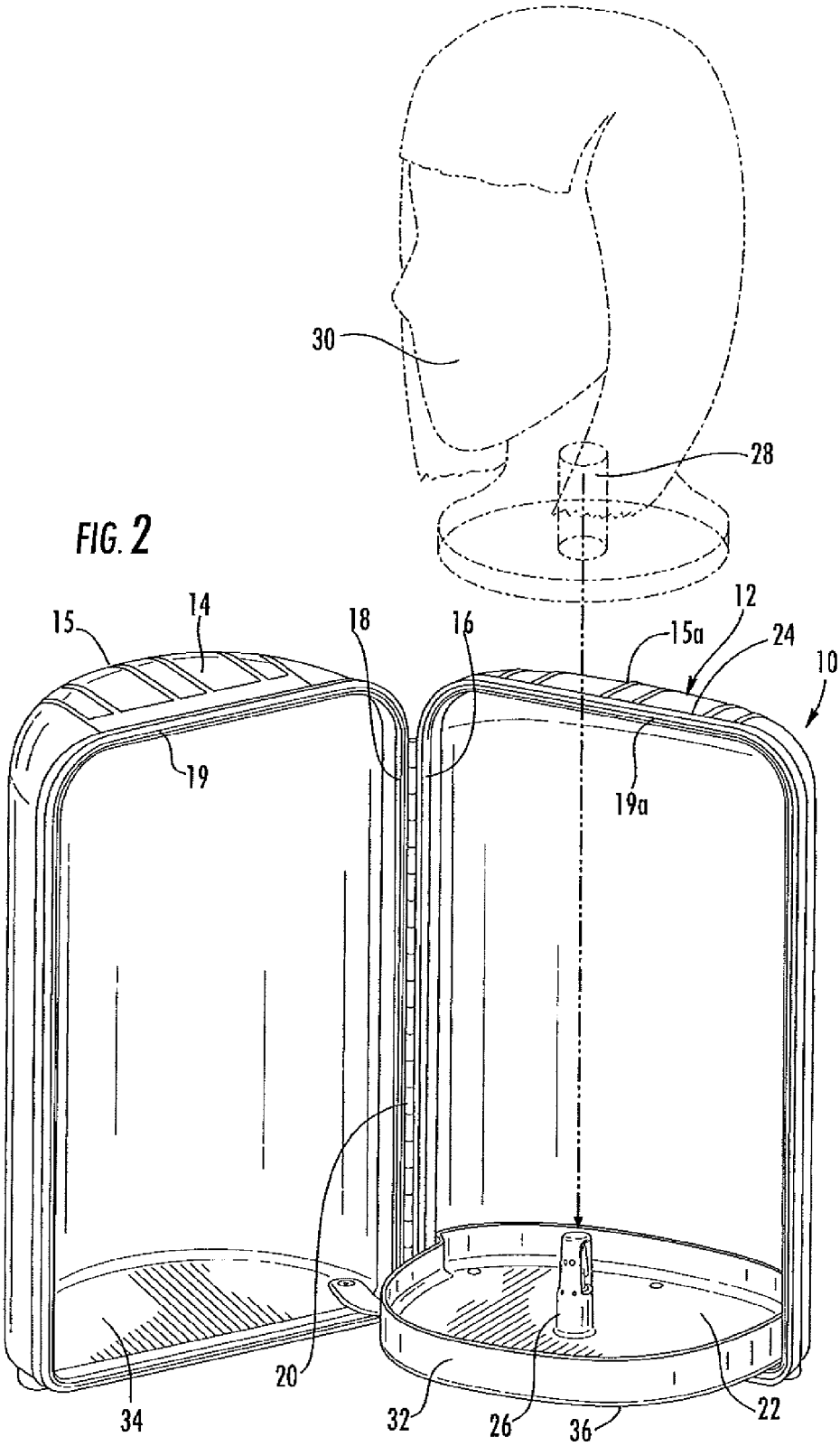
FIG. 2 is a front perspective view of an open carrying case according to an embodiment of the invention.

FIG. 2 shows the wig carrier 10 in an open position. As shown, each of the panels 12, 14 has a substantially parallel straight edge 16, 18. Edges 16 and 18 of corresponding panels 12 and 14 are joined by one or more hinges 20, live hinges, or similar pivoting mechanism. Hinges 20 allow the panels to pivot laterally about the axis of the hinge to open and close the carrier as desired. One of the panels is provided with a floor surface that extends in a lateral direction farther than its roof surface. In the embodiment shown, panel 12 has a floor surface 22 and a roof segment 24. Floor surface 22 extends laterally (i.e. toward the midpoint of the closed carrier) a greater distance than roof segment 24.

An upward projecting cylindrical rod 26 (also referred to as a "post" herein) or similar bar is attached to the floor surface 22 in an orientation that is substantially orthogonally thereto. Post 26 is sized and shaped to insert into a similarly sized channel 28 or elongated pocket which opens on the underside of a wig head 30. Channel 28 captures post 26 in a frictional grip and it thereby secures the wig head to the rod.

Because the floor surface 22, which receives the wig head, extends past the roof section 24—a user may insert the wig head by inserting the wig head in a straight downward motion onto the post 26. That is, because there is no roof portion directly above post 26—a user may place a wig head in a downward motion without being obstructed by a roof. The arrow in FIG. 2 illustrates that the wig head may be lowered downward in a straight line onto post 26. It will be understood by those of ordinary skill in the art that any of various panel configurations are possible in different embodiments of the invention. The panels may be rounded or variously shaped so long as one panel is provided with a floor surface that extends in a lateral direction past a roof section that is disposed thereabove.

In an embodiment of the invention, and as shown in FIG. 2 floor plate 22 is partially or completely surrounded by a wall 32. Long wig hairs that extend past the base of the wig head 30 will be captured and maintained within wall 32. Plate 22 is preferably mounted to panel 12 such that it is fixed higher in space than floor 34 of panel 14. As such, when the carrier 10 is closed, underside surface 36 of plate 22 clears floor surface 34—remaining substantially parallel thereoto.

It should be understood that the invention is broadly directed to a wig carrier that is comprised of two cooperating panels and which opens along its longitude—either by way of a hinges or by rotating a panel about the axis of the carrier. In a preferred embodiment one panel is provided with a floor surface that extends farther in the direction of the center point of the carrier than does a roof section disposed thereabove. A rod or post for receiving a wig head is mounted or otherwise secured to the floor surface. In an embodiment of the invention, the post is movable to tilt toward a user so as to make the insertion of a wig head more convenient.

Figure 3:
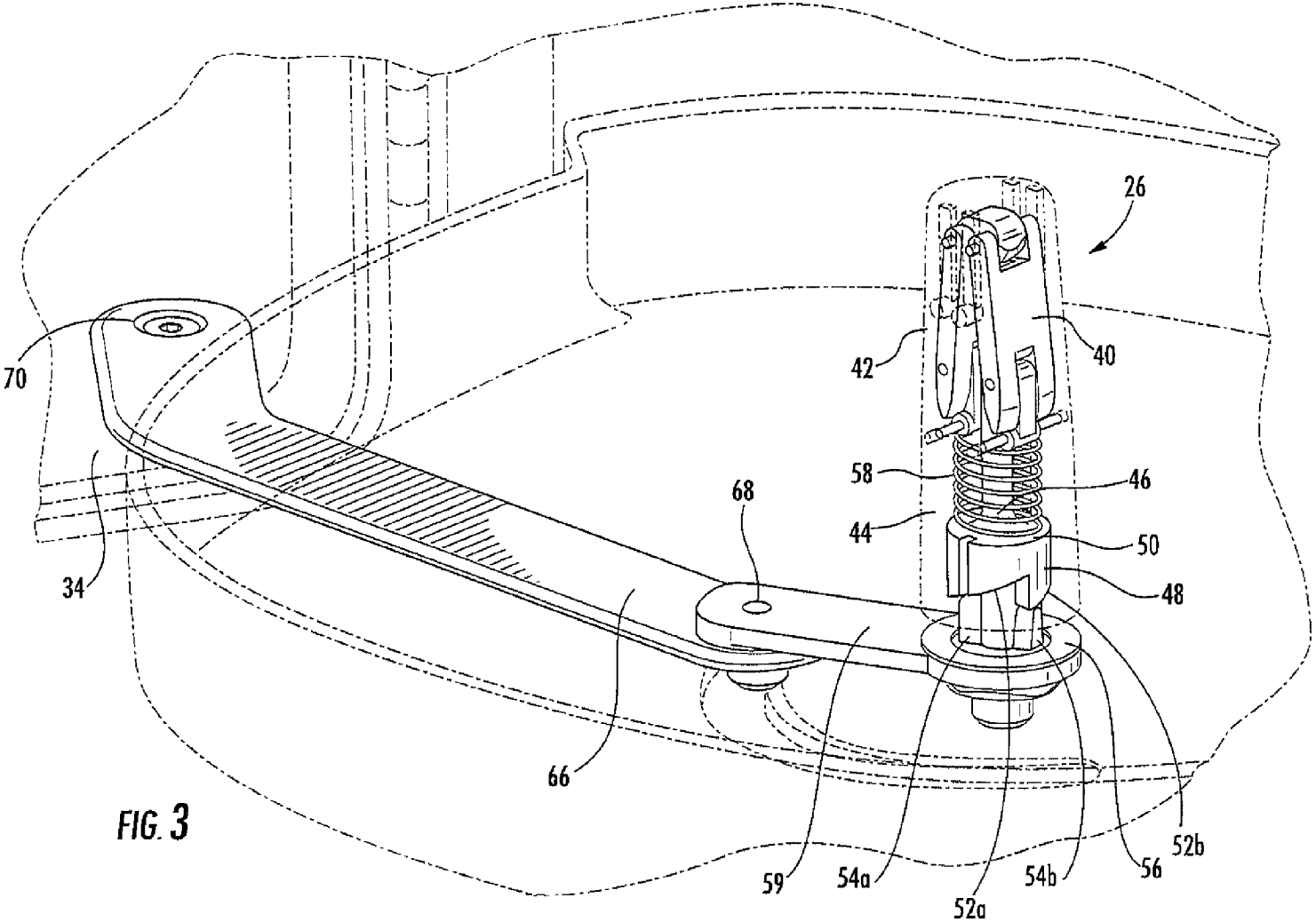
FIG. 3 is a breakaway transparent view of a post for holding a wig head according to an embodiment of the invention.
Figure 6:
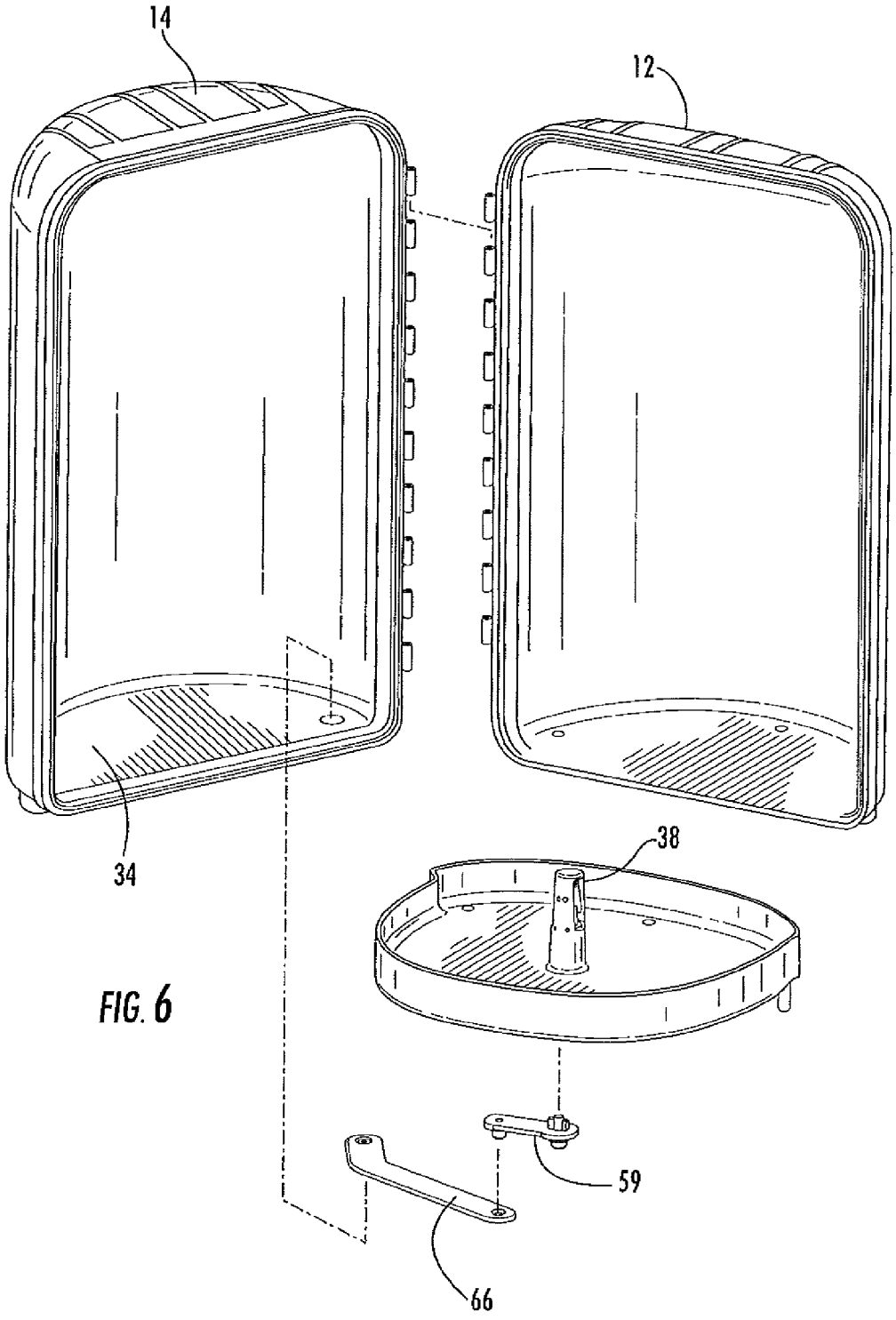
FIG. 6 is an exploded view of a carrying case according to an embodiment of the invention.

In a preferred embodiment, post 26 is provided with a securing mechanism for securing a wig head thereon. FIG. 3 shows a securing mechanism according to an embodiment of the invention. Post 26 is sized and shaped to insert into a channel on the underside of a wig head. Two cutouts 38 (cutouts best seen in FIG. 6) are made in the upper segment of post 26. Preferably, the cutouts 38 are positioned to be substantially in diametric opposition to one another.

Figure 5:
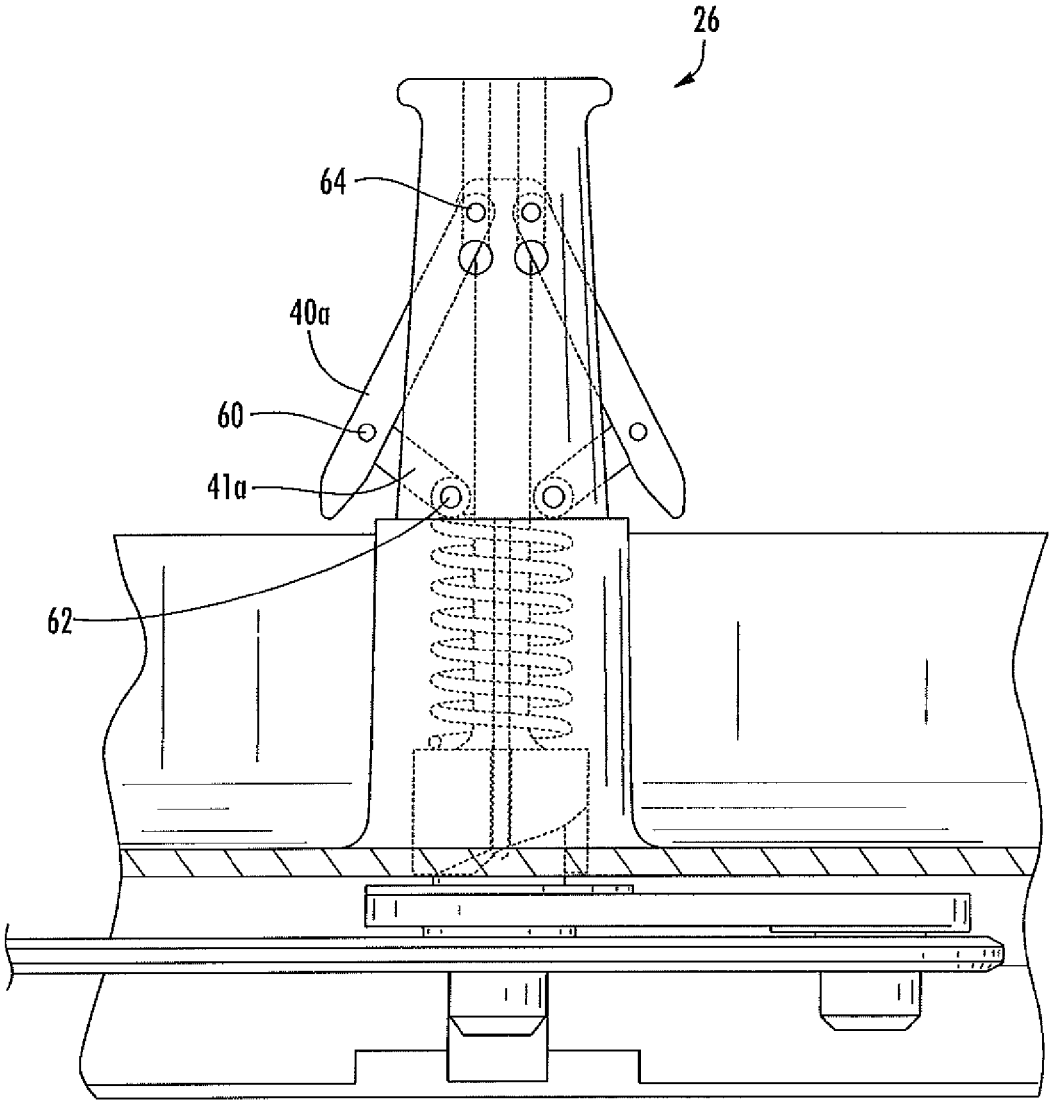
FIG. 5 a side breakaway view of a post for holding a wig head showing contact members protruding from cutouts according to an embodiment of the invention.

One or more contact members 40 are housed within the inner cavity of the post and which are movable to bear against the inside walls of channel 28 in a wig head and thereby secure the wig head 30 to post 26. FIG. 5 shows a post 48 where contact members 40*a*, 40*b* are fully extended from respective cutouts. Thus, once a user mounts a wig head to post 26, she may deploy the contact members 40*a*, 40*b* to move laterally to bear against the channel 28 of the wig head 30. This ensures that the wig head remains securely in place during movement and it protects against inadvertent slippage of the wig head from post 26.

Referring to FIG. 3, where post 26 is shown transparently, contact members 40 are shown in a folded, non-deployed position. As shown, contact members 40 are folded to fit within the confines of post 26.

The interior cavity of post 26 is substantially divided into two different regions or chambers. An upper region 42 houses the contacting members 40 and a lower region 44 houses the mechanical components for actuating the contact members 40.

As shown, a rod 46 runs through the center of the post 26. Rod 46 has a lower end that is attached to a collar 48 and an upper end that terminates near the top of the interior of the post 26. Rod is movable in a horizontal plane (i.e. upwardly and downwardly with respect to plate 22); however, it is not capable of rotation. Collar 48 has an upper flat surface 50, and a lower surface having two curved walls or ramps 52*a*, 52*b*. Ramps 52*a*, 52*b* rest on respective pegs 54*a*, 54*b*. Top ends of pegs 54*a*, 54*b* contact the respective ramps 52*a*, 52*b* and bottom ends of pegs 54*a*, 54*b* are attached to a disc 56. Disc 56 rotates in a lateral plane (clockwise and counterclockwise) but it does not move in a horizontal plane (i.e. up and down). A lever or handle 59 extends from disc 56.

A spring 58 is mounted in the space between the collar 48 and the bottom of the upper chamber 42. A first end of spring contacts the upper flat surface 50 of collar 48 and a second end is mounted or secured to an area below contact members 40. Spring 58 provides a downward biasing force against collar 48.

When handle 59 is moved (rightward, or counterclockwise in the embodiment shown), disc 56 and attached pegs 54*a*, 54*b* accordingly move. Pegs 54*a*, 54*b* ride along ramps 52*a*, 52*b* as they are rotated. Because the ramps slope upward (i.e. the distance between the top surface 50 of collar and the ramp decreases as the ramp slopes to the right), collar 48 travels downward as pegs 54*a*, 54*b* ride along ramps 52*a*, 52*b*. For example, in FIG. 3, pegs 54*a*, 54*b* are situated beneath the ramps in an area of greatest distance between the ramp and the top surface 50 of collar 48. As such, collar 48 is positioned at its highest point within lower chamber 44. In FIG. 5, on the other hand, pegs 54*a*, 54*b* are positioned below an area where the ramp is at its smallest distance from the top surface 50 of collar 48. In this position, collar 48 is pulled to its lowest point within lower chamber 44. Spring 58 applies a constant biasing force against the top 50 of collar 48 maintains the ramps 52*a*, 52*b* in constant contact with peg 54*a*, 54*b*.

Figure 4:
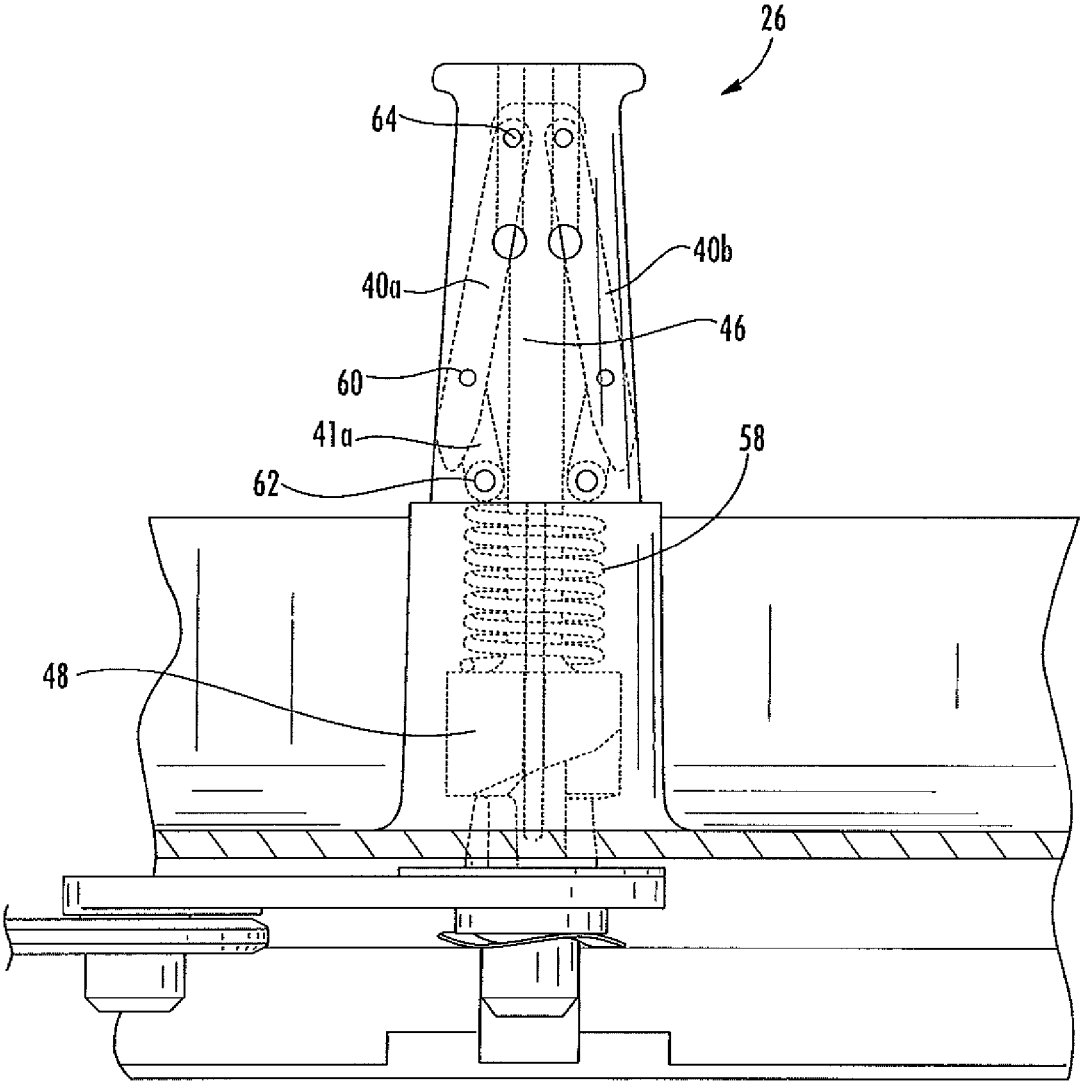
FIG. 4 is a side breakaway view of a post for holding a wig head according to an embodiment of the invention.

When collar 48 travels downwardly, attached upper rod 46 correspondingly moves downward. Contact members 40 move laterally out of the cutouts as a consequence of upper rod 46 moving downward because of the following: Each contact member 40 is constructed having two arm segments that are joined by a pivot or similar movable linkage. As best shown in FIG. 4, lower arm segment 41*a* is shown joined to an upper arm segment, (which is contact member 40*a*), by way of pivot 60. A first end of lower arm 41*a* is attached to post interior by way of pivot 62. Upper arm segment (which is contact member 40*a*1 is attached to the top of rod 46 by way of pivot 64. As such, when rod 46 moves downward, contact members 40*a*, 40*b* are caused to bend at the center pivot 60 and extend laterally to protrude out of cutouts 38. FIG. 5 shows post 26, where rod 46 is at its lowest point and the contact members 40*a*, 40*b* are fully extended to contact the inside channel 28 of a wig head 30.

In use, a user places a wig head on post 26 and then turns the handle to deploy the contact members. When the wig head is to be removed, the handled is turned in the opposite direction—thereby causing the contact members to be withdrawn into the post interior. However, in an embodiment of the invention, the contact members are automatically deployed as soon as a user closes the carrier.

FIG. 3 shows an embodiment of a system where the contact members 40 are automatically deployed when the carrier is closed. As shown, a first end of a lever 66 is attached to handle 59 by way of pivot 68 and a second end of lever 66 is attached to the floor surface 34 of second panel 14 by way of pivot 70. As such, when the two panels are brought together into a closed position, lever 66 bears against handle 59 and rotates the same. As explained above, counterclockwise rotation of handle 59 causes the deployment of contact members 40. In this embodiment, each time the user closes the carrier, the wig head securing mechanism is automatically engaged. In other embodiments of the invention (for example, as shown in FIG. 7), a handle 96 that is accessible to a user is used to manually engage the securing mechanism.

Figure 7:
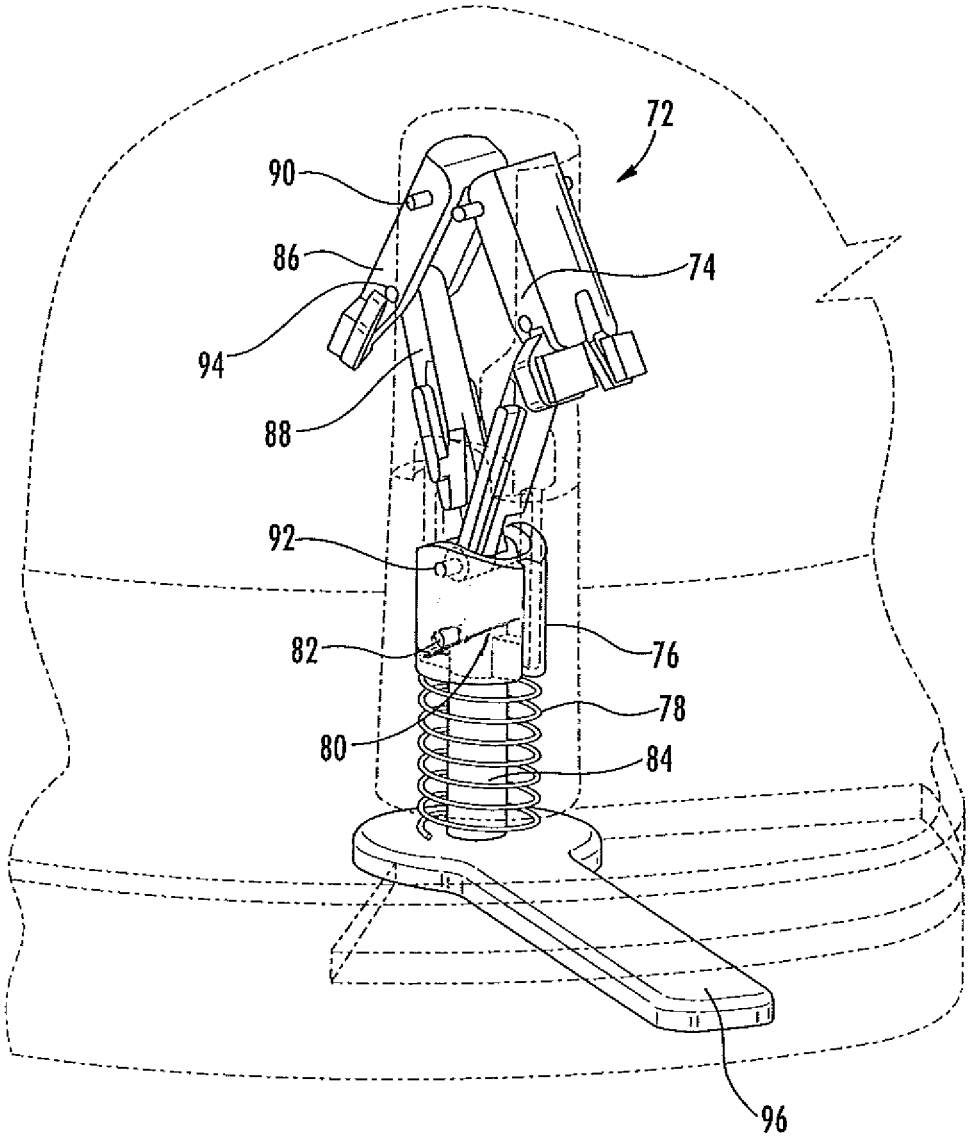
FIG. 7 is a breakaway transparent view of a post for holding a wig head according to an embodiment of the invention.

FIG. 7 shows a transparent view another embodiment of a wig head securing mechanism. In the embodiment shown, post 72 is similar to that of post 26 in that it houses contact members that are deployed by moving laterally out of cutouts 74. A collar 76 is shown having a spring 78 disposed below thereto. Spring 78 is placed with one end contacting the floor (or any surface below the collar) and a second end contacting the bottom of collar 76—thereby biasing the collar 76 upwardly. The bottom surface of collar 76 has a curved wall which forms a ramp 80. A peg 82 which travels along ramp 82 causes collar 84 to move up and down. Peg 82 extends from rod 84 such that when rod 84 is rotated—peg 82 similarly rotates. Because collar 76 is biased upward—it will move upward unless such upward movement is blocked by a physical barrier. Movable peg 82 (which only rotates—but does not move in a horizontal plane) serves as such a physical barrier. When peg 82 contacts the ramp 80 at its highest point (where the ramp is closest to the top of the collar) it keeps the collar 84 at its lowest position (i.e. closest to floor). However, as peg 82 rotates and contacts ramp 80 at lower points—the collar 76 moves upward as peg 82 rides across ramp 80. That is, in FIG. 7 as rod 84 rotates to the left, because ramp slopes down to the left, the collar will continually move upward as rod 84 is turned.

When collar 76 moves upward it pushes up on lower contact arm 88 which is attached to collar 76 via pivot 92. Lower arm, 88 in turn, pushes up on upper arm 86 at pivot 94. Upper arm 86, thus, moves laterally and upward to bear against an inside channel 28 of a wig head 30.

In a preferred embodiment, contact surfaces are provided on upper arms 86 for contacting the inner walls of the wig head channel. Contact surfaces are one or more appendages made of material having a frictional quality. Contact surfaces allow for a firm, tight grip when contact placed in close contact with the channel walls.

In one embodiment, contact surfaces or contact members actually burrow into and create an indentation in the channel walls of a Styrofoam wig head. In the embodiments shown in FIGS. 3-6, the contact members 40 move laterally and in a downward direction. That is, when rod 46 moves downward, upper arm (which is contact member 40*a* pushes downward on lower arm 41*a*—causing a lower arm to bear a downward bearing force into the inside channel of a wig head. In FIG. 7, on the other hand, arm 86 moves laterally and in an upward direction to bear against the inside channel of a Styrofoam head.

It will be understood that the invention relates to any apparatus and/or method for providing a post that receives a wig head and then moving an aspect of the post in a lateral direction to bear against the inside channel of a wig head. The contact members and operation thereof are exemplary only. For example, in one embodiment, a post may be formed of two post halves (i.e. a two half cylinders back to back to substantially form a cylinder). The post halves may each move slightly laterally to bear against the inside channel of a wig head. Alternatively, only one of the post halves move laterally to bear against a wig head channel. It will be further understood that any of various arms, levers, support members or other appendages that move laterally to contact an inside surface of a channel in a wig head are referred to as "contact members" herein.

Having described this invention with regard to specific embodiments, it is to be understood that the description is not meant as a limitation since further modifications and variations may be apparent or may suggest themselves to those skilled in the art. It is intended that the present application cover all such modifications and variations.

What is claimed is:

1. A carrying case comprising, a first panel;

a second panel;

said first panel being hingedly connected to said second panel;

said first panel comprising a floor surface and a roof surface;

said floor surface extending in a lateral direction past said roof surface;

said second panel comprising a floor surface, whereby the floor surface of the first panel is disposed higher in space than the floor surface of the second panel, such that when the carrying case is closed, an underside surface of the floor surface of the first panel is substantially parallel to the floor surface of the second panel, said floor surface of the first panel comprising a post attached substantially orthogonally thereto that is sized and shaped to receive an inside channel of a wig head.

2. The carrying case of claim 1, whereby said floor surface of said first panel is surrounded by a wall.

3. The carrying case of claim 1, whereby said post comprises an inner housing and cutouts.

4. The carrying case of claim 3, whereby the inner housing further comprises contact members stored therein and mechanical components for moving the contact members laterally out of the post to bear against the inside channel of a wig head.

5. The carrying case of claim 4, whereby each of said contact members comprises an upper arm having a first end and second end, the first end of the upper arm linked to a movable rod and the second end of the upper arm linked to a lower arm.

6. The carrying case of claim 4, further comprising a collar movably mounted in said inner housing, said collar being linked to said contact members.

7. The carrying case of claim 6, whereby the collar is linked to the contact members through a movable rod.

8. The carrying case of claim 6, whereby the collar is movable in an upward direction and a downward direction, whereby when the collar is moved in a downward direction the movable rod exerts force on said contact members and cause the contact members to move laterally.

9. The carrying case of claim 4 whereby said contact members are linked to the second panel such that the movement of the second panel engages the mechanical components to move the contact members laterally.

10. The carrying case of claim 9, further comprising a handle that is linked to a collar, whereby movement of said second panel moves the handle, whereby movement of the handle causes rotation of said collar.

* * * * *